United States Patent [19]

Barlow

[11] 4,126,967

[45] Nov. 28, 1978

[54] DEVICES FOR USE IN RE-SHARPENING FLUTED CUTTING TOOLS AND THE LIKE

[75] Inventor: Peter Barlow, Sheffield, England

[73] Assignee: James Neill Holdings Limited, Sheffield, England

[21] Appl. No.: 662,071

[22] Filed: Feb. 27, 1976

[51] Int. Cl.[2] ..... B24B 19/00

[52] U.S. Cl. ..... 51/219 R

[58] Field of Search ..... 51/219 R, 220, 221 R, 51/225, 219 PC, 157, 125.5, 124 R

[56] References Cited

U.S. PATENT DOCUMENTS

| | | | |
|---|---|---|---|
| 193,748 | 7/1877 | Brown | 51/221 R |
| 201,449 | 3/1878 | Rider | 51/219 R |
| 2,275,483 | 3/1942 | Parker | 51/219 PC |
| 2,454,472 | 11/1948 | Monkley | 51/124 R |
| 2,614,370 | 10/1952 | Kapnick | 51/124 R |
| 3,380,200 | 4/1968 | Kirwin | 51/124 R |

*Primary Examiner*—Harold D. Whitehead
*Assistant Examiner*—Roscoe V. Parker
*Attorney, Agent, or Firm*—Lowe, King, Price & Becker

[57] ABSTRACT

A device for use in re-sharpening fluted cutting tools comprises a body, means on the body adapted to set the tool in a position whereby one front cutting edge is correctly exposed, means on the body adapted to secure the tool in that position and means on the body adapted to cause oscillatory movement of the cutting tool in a generally longitudinal plane of the tool as the device is moved along an abrasive surface.

11 Claims, 4 Drawing Figures

DEVICES FOR USE IN RE-SHARPENING FLUTED CUTTING TOOLS AND THE LIKE

This invention relates to devices for use in re-sharpening fluted cutting tools.

Fluted cutting tools, such as drills, have at least two cutting edges at the front where the helix breaks out. During use, wear takes place at the front end of such tools with a consequent blunting of the cutting edges. Hitherto, re-grinding means or re-sharpening means for the cutting edges have been expensive and only suited to industrial application, and the alternative of hand sharpening such tools involves a high degree of skill on the part of the operator, and the use of a grinding wheel.

The object of the present invention is to provide a device for use in re-sharpening the cutting edges of fluted cutting tools, capable of use by an unskilled operator.

According to the present invention a device for use in re-sharpening fluted cutting tools comprises a body, means on the body adapted to set the tool in a position whereby one front cutting edge is correctly exposed, means on the body adapted to secure the tool in that position, and wheel means for enabling riding of the body on a flat, abrasive surface. Means on the body driven by the enabling means causes oscillatory movement of the back end of the cutting tool on an arc about a point of engagement of the tool with the abrasive surface by oscillating one end of the body in a longitudinal direction of the tool as the device is moved along the abrasive surface.

By providing an oscillatory movement as the device is moved across the abrasive surface, one half of the fluted tool is correctly re-ground with a convex surface from the core of the tool to the cutting edge, in a manner which maintains a correct chisel edge and provides the required helical relief behind the lip or cutting edge, following which simple re-positioning of the fluted tool is effected such that the other half is correctly presented to the abrasive surface to allow the other half to be correctly re-ground with its convex form, with of course consequent re-sharpening of the cutting edge.

Preferably, the oscillatory motion is provided by securing the fluted tool rigidly to the body and providing means on the body whereby the body and thus the tool is subjected to oscillatory movement. The means on the body may be one or more wheels eccentrically mounted on the body. Alternatively, the tool itself can be mounted in the body such that it can be driven in an oscillatory manner. In either case, the body is provided with abutment means adapted to contact the abrasive surface whereby re-grinding of the tool in excess of that required is prevented. Such abutment means may be a wheel or wheels mounted on the body.

The means on the body adapted to secure the tool in position may be a passage through the body and a locking screw adapted to clamp the tool in the passage. Alternatively, a clamping plate with a captive screw which engages a hole in the body, may be provided to clamp the tool to the body in the passage. It is however preferred to provide a support member for the tool and which is held to the body by a screw, the support member having a longitudinal recess to receive the tool and there being a clamping plate with a screw engaging a threaded hole in the support member, which clamping plate clamps the tool to the support member. The support is set so that the normal point angle is reproduced on the tool during regrinding. However, the support may be capable of angular adjustment with respect to the body so that any required point angle can be ground on to the tool.

To facilitate correct positioning of the tool with respect to the abutment means, stop means are provided on the body or in the preferred construction on the tool support member, against which the fluted cutting tool abuts, and a shim is interposed between the stop means and the end of the fluted cutting tool whereby the front cutting edge is exposed below the abutment means whereby the same amount of material is removed from each half of the tool by the time the abutment means contact the abrasive surface. Thus, the tool may be introduced into the passage in the body or the recess in the support member, with the body and the abutment means in contact with a flat surface and the tool urged generally downwardly until the front cutting edge contacts the flat surface. The stop means may then be brought into contact with the back end of the cutting tool and locked in position. A shim, preferably pivotally secured to the stop means, is then introduced between the stop means and the end of the tool, when the front cutting edge is caused to project beyond the abutment means by the thickness of the shim.

It is further preferred to provide means on the body to ensure that the cutting tool is set correctly, such that the front cutting edge is properly presented to the abrasive surface. Thus, the body may be provided with a setting device pivotally secured to the body and capable of being swung from an inoperative position to a position below the front end of the cutting tool. The setting device is so shaped and so positioned that on urging the tool into contact with the setting device rotation of the tool brings it to a position where corresponding faces on the tool and the setting device are in contact and when resistance to further rotation is readily detected. In that position one half of the tool is correctly positioned and presented to the abrasive surface. It is however preferred to provide means on the body adjustable in position to accommodate several diameters of fluted tool, which not only serve to set correctly the tool, but also serve to align the front cutting edge with the bottom of the abutment means. Thus, a member having a flat surface may be slidably mounted on the body or the lower end of the tool support member, and in its correct position for a particular tool diameter is adapted to be engaged by the lip tool. Thus with the tool introduced into the passage in the body or the recess in the support member, it is then rotated until the generally straight lip or cutting edge of the tool contacts and is aligned with the lower edge of the flat surface of the slidable member. The tool is then clamped, the stop means brought up to the back end, the clamps released slightly, the shim introduced and the tool re-clamped.

The stop means contacting the rear edge of the tool additionally serves to ensure that both cutting edges of the tool are ground to the same extent. Thus, following re-positioning of the tool, urging of the tool rearwardly to ensure contact with the stop means by the back end of the tool automatically means that each front cutting edge projects beyond the abutment means by the same amount when they are presented for re-sharpening.

The use of shim to control the extent of projection of each cutting edge beyond the abutment means has the additional advantage that a badly worn tool can be correctly sharpened. Thus, with the tool set as has been described above, the shim can be removed, and the stop means brought into contact with the back end of the tool. With the shim reintroduced, the tool has then been advanced by twice the shim thickness thus enabling a greater degree of re-sharpening to be effected. Obviously, the above can be repeated to advance the tool by any multiple of the thickness of the shim.

One embodiment of the invention will now be described by way of example only, with reference to the accompanying drawings, in which.

Figure 1:
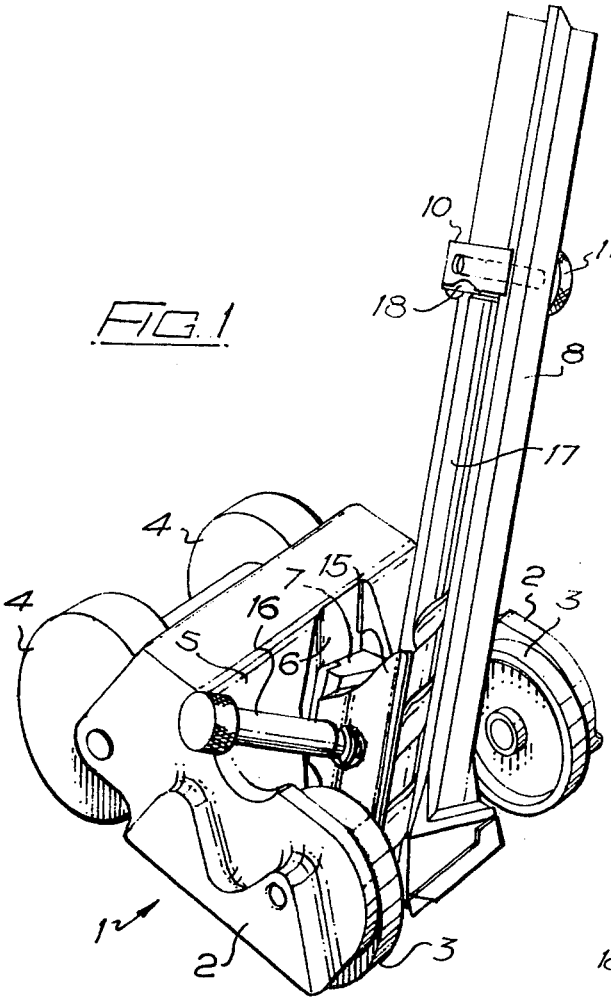
FIG. 1 is a front perspective view of a drill re-sharpening device according to the present invention.

In the drawings, a drill re-sharpening device has a body 1 shaped at 2 to allow the body to be held conveniently by the hand. At the front of the device, abutment means in the form of co-axial wheels 3 are provided, and at the rear of the body, means to give the body and oscillatory motion in the form of wheels 4 having an offset axis of rotation are provided.

Figure 3:
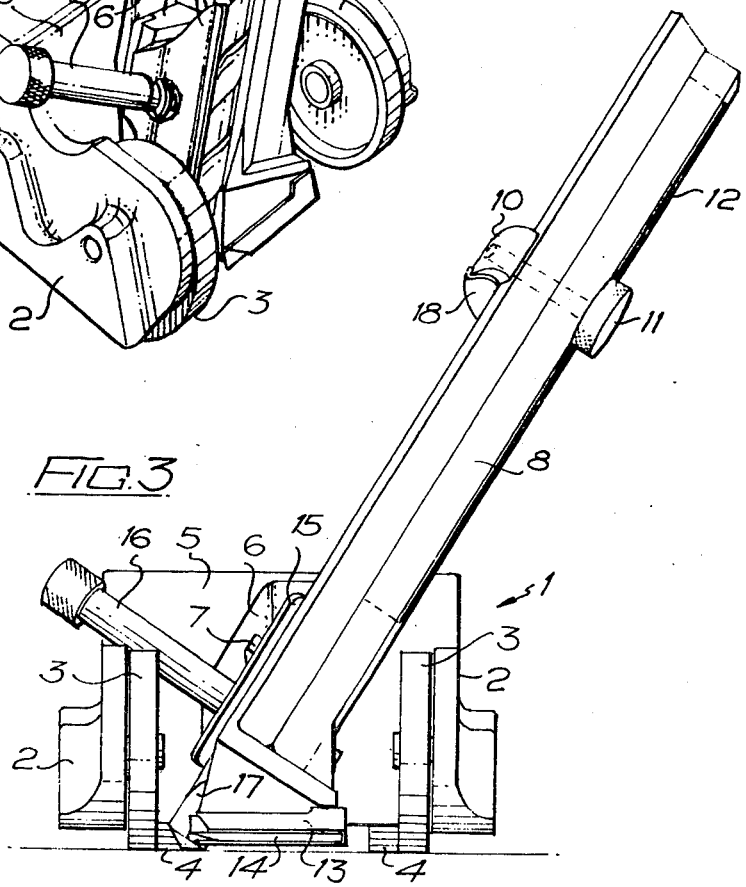
FIG. 3 is a front elevation of the device of FIG. 1.
Figure 5:
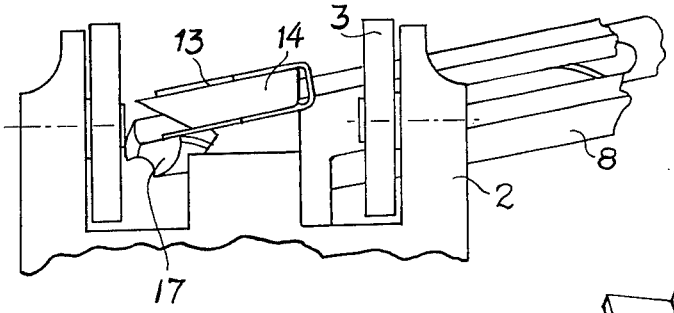
FIG. 5 is a bottom elevation of the device of FIG. 1.
Figure 2:
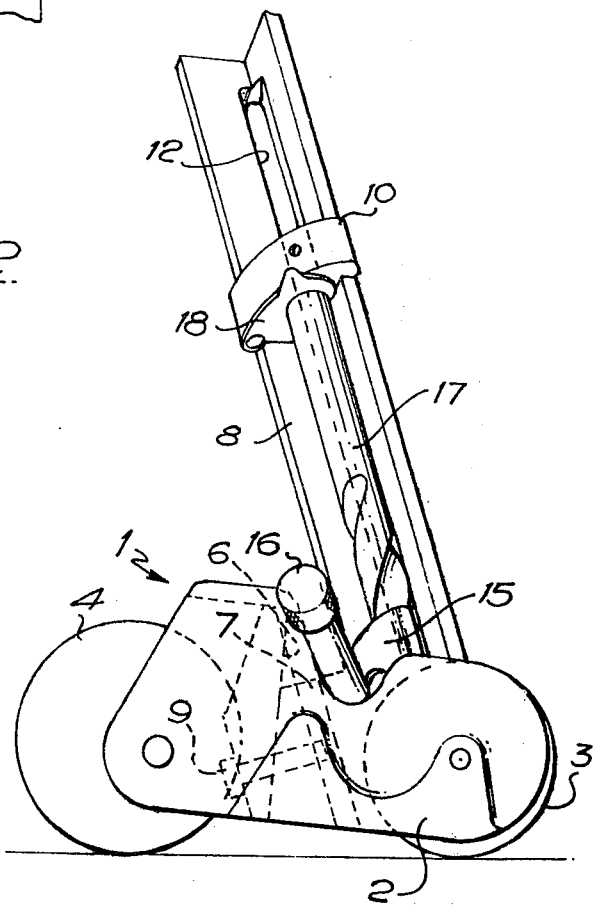
FIG. 2 is a side elevation of the device of FIG. 1.
Figure 4:
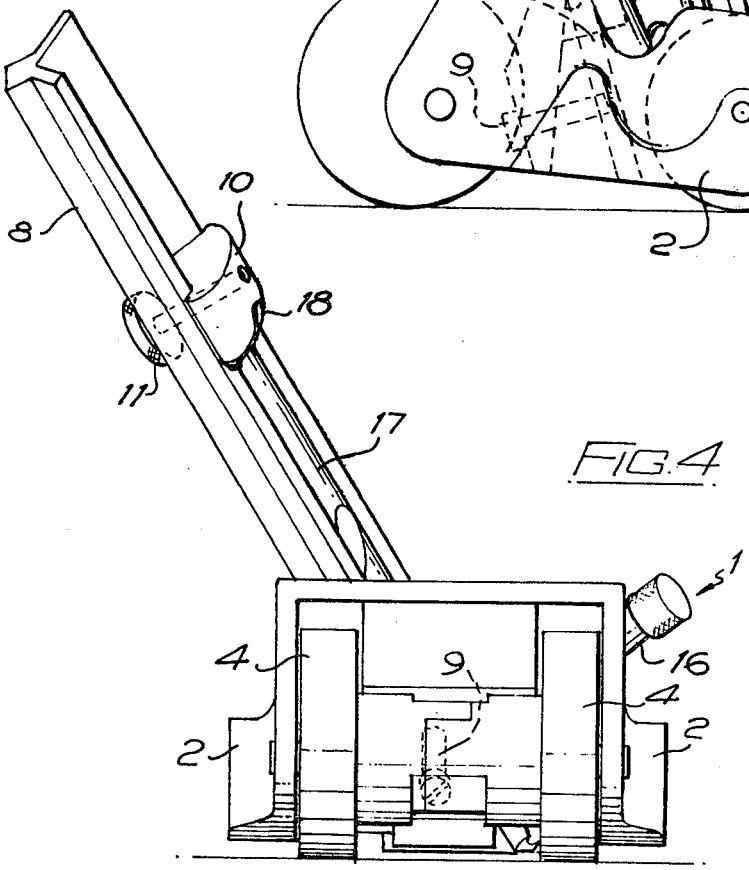
FIG. 4 is a rear elevation of the device of FIG. 1.

The body 1 has a transverse face 5 lying rearwardly of the front wheels 3, there being a recess 6 in the face, which receives a projection 7 on an upwardly extending generally "V" shaped tool support member 8, a screw 9 securing the projection in the recess and thus the support member 8 to the body 1. Towards the upper end of the support member, stop means 10 are provided, there being a screw 11 passing through a longitudinal slot 12 in the support member and into a threaded hole in the stop means, the slot allowing the stop means to be positioned at any point along the length of the support member. At the lower end of the support member, tool setting means 13 (see FIGS. 3 and 5) are provided in the form of a "U" shaped member embracing a projection 14 on the lower end of the support member. The innermost arm of the "U" shaped member constitutes a flat face to be engaged by the tool and its lower edge is aligned with the bottoms of the wheels 3. The member 13 is slidably mounted for adjustment to accommodate different diameters of tool. Mounted on the support member 8 is a clamping plate 15 having a captive screw 16 passing into a threaded hole in the projection 7. Thus, with a fluted cutting tool 17 introduced into the generally "V" shaped support member 8, and with the stop means 10 withdrawn and the tool setting member 13 in the correct position for a particular tool diameter, the tool is urged down the support member and between the support member and the clamping plate 15, until the drill is aligned with the setting member 13. The drill is then rotated until, as shown in FIG. 5, one cutting edge contacts the innermost arm of the member 13 along its length and the cutting edge positioned that it is co-planar with the bottom edge of that arm. The screw 16 is then rotated to lock the tool by the clamping plate to the support member, and when the cutting edge is aligned with the bottoms of the wheels 3. The stop means is then brought against the back end of the tool, and secured by the screw 11. The screw 16 is then slackened, and a shim 18 pivotally secured to the stop means is introduced between the stop means and the tool, following which the tool is re-clamped to the support member. The cutting edge of the tool still correctly aligned, now projects beyond the bottoms of the wheels by the thickness of the shim.

By placing the body on an abrasive surface, the body is then urged across the abrasive surface and the offset wheels 4 cause the body to have an oscillatory motion which in turn ensures correct re-grinding of the front cutting edge of the tool. Re-grinding continues until the front wheels 3 abut the abrasive surface and prevent further regrinding of the flank of the tool.

To regrind the other cutting edge, clamp is released from the support and the tool rotated through 180°. The unsharpened cutting edge is now aligned with the setting member as before, and re-clamping of the tool so that the worn cutting edge projects beyond the wheels 3 by the same amount as the first cutting edge. Regrinding is then effected as described above. If a tool is badly worn, regrinding by an amount greater than the shim thickness can easily be effected. Thus, following final clamping of the tool as described above, the shim can be removed and the stop means brought into contact with the back end of the tool and locked in place. The tool can then be unclamped, the shim reintroduced and the tool clamped once more to the support member. The cutting edge of the tool now projects beyond the bottoms of the wheels by twice the shim thickness. It will therefore be understood that either cutting edge may be caused to project by any multiple of the shim thickness as may be required.

What we claim is:

1. A device for use in re-sharpening a fluted cutting tool, comprising a body adapted to be transported over a flat, abrasive surface, said body including means for supporting the tool, means for setting the tool in a position with one front cutting edge of the tool maintained correctly exposed to said flat, abrasive surface with the cutting edge of said tool in engagement with said surface for re-sharpening, means for securing the tool in that position, means riding on said flat, abrasive surface for enabling said body to be transported along the surface, and means driven by said transport enabling means for oscillating a back end of the cutting tool on an arc about a point of engagement of the cutting tool with the flat, abrasive surface by oscillating one end of the body in a longitudinal direction of the tool.

2. A device as in claim 1, wherein the body is provided with abutment means comprising at least one wheel mounted on the body and adapted to contact the abrasive surface, said wheel providing in the cutting tool an oscillatory movement about the axis of said wheel, whereby re-grinding of the tool in excess of that required is prevented.

3. A device as claimed in claim 1, wherein said last named means includes one or more wheels eccentrically mounted on the body.

4. A device as in claim 1, wherein the means on the body adapted to secure the tool in position is a passage through the body and a locking screw adapted to clamp the tool in the passage.

5. A device as in claim 1, wherein a clamping plate with a captive screw which engages a hole in the body is provided to clamp the tool to the body.

6. A device as in claim 1, wherein the means on the body adapted to secure the tool in position is a support member removably secured to the body, the support member having a longitudinal recess to receive the tool and there being a clamping plate with a screw engaging a threaded hole in the support member.

7. A device as in claim 6, wherein stop means are provided on the support member against which the tool abuts to facilitate correct setting of the tool.

8. A device as in claim 2, wherein stop means are provided on the body against which the tool abuts to facilitate correct setting of the tool.

9. A device as in claim 8, wherein a shim is interposed between the stop means and the end of the tool whereby the front cutting edge is exposed below the abutment means and whereby the same amount of material is removed from each half of the tool by the time the abutment means contact the abrasive surface.

10. A device as in claim 1, wherein means are provided on the body to ensure that the cutting tool is set correctly such that the front cutting edge is properly presented to the abrasive surface.

11. A device as in claim 10, wherein a member having a flat surface is slidably mounted on the body or the lower end of the tool support member, and in its operative position is adapted to be engaged by the tool.

* * * * *